US006322198B1

(12) United States Patent
Higashino et al.

(10) Patent No.: US 6,322,198 B1
(45) Date of Patent: Nov. 27, 2001

(54) ELECTROSTATIC INKJET HEAD HAVING SPACED ELECTRODES

(75) Inventors: Kusunoki Higashino, Osaka; Hisashi Takata, Nishinomiya; Yasuhiro Sando, Amagasaki; Yasuhisa Fujii, Kyoto, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/286,637

(22) Filed: Apr. 2, 1999

(30) Foreign Application Priority Data

Apr. 7, 1998 (JP) ..... 10-094426
Apr. 13, 1998 (JP) ..... 10-101160

(51) Int. Cl.[7] ..... B41J 2/04
(52) U.S. Cl. ..... 347/54
(58) Field of Search ..... 347/68, 69, 70, 347/71, 72, 50, 40, 55, 54; 399/261; 361/700; 310/328–330; 29/890.1

(56) References Cited

U.S. PATENT DOCUMENTS 6,000,785 * 12/1999 Sakai et al. ..... 347/54

FOREIGN PATENT DOCUMENTS 6-340069 12/1994 (JP) .
7-246706 9/1995 (JP) .
9-039235 2/1997 (JP) .

* cited by examiner

*Primary Examiner*—John Barlow
*Assistant Examiner*—Raquel Yvette Gordon
(74) *Attorney, Agent, or Firm*—Sidley Austin Brown & Wood

(57) ABSTRACT

An electrostatic inkjet head has first and second electrodes. The first electrode is supported on a substrate and the second electrode is on a diaphragm so that a gap is formed between the first and second electrodes. A drive circuit is connected to the first and second electrodes to apply a voltage or pulse between the electrodes. When a voltage is applied between the electrodes, an electrostatic attraction force is generated between the electrodes. The attraction force displaces the diaphragm toward the substrate. This displacement of the diaphragm is used for the ejection of ink. Also, when the voltage is turned off, opposing central portions of the first and second electrodes define a gap that is greater than that defined by opposing end portions of the first and second electrodes. On the other hand, when the voltage is turned on, the opposing central portions of the first and second electrodes define another gap that is substantially equal to that defined by the opposing end portions of the first and second electrodes.

8 Claims, 9 Drawing Sheets

150
152
154
116

SAND-BLAST
116
150
152
154
166

PHOTORESIST
116
166

EXPOSURE
116
150
152
154
168
166

ETCHING
116
150
152
154
168
166
EXPOSURE 150
170
152
154
168
116
166
ETCHING 116
150
152
170
154
168
166
EXPOSURE 116
172
170
168
166
ETCHING 116
156
142
158
144
160
146
166
SPUTTERING 116
156
142
148
158
144
160
146
166
REMOVE PHOTORESIST

ELECTROSTATIC INKJET HEAD HAVING SPACED ELECTRODES

FIELD OF THE INVENTION

The present invention relates to an electrostatic inkjet head having a pair of spaced electrodes.

BACKGROUND OF THE INVENTION

Japanese Patent Laid-Open Publications Nos. 6-340069 and 7-246706 each disclose an electrostatic inkjet head generally illustrated in FIG. 8. The inkjet head, generally indicated by reference numeral 70, includes three major parts; cover plate 72, channel plate 74 and substrate 76. These parts are assembled and fixed to each other. The channel plate 74 made from a silicon plate is formed with a number of grooves on an upper surface thereof by etching. The grooves are covered with the cover plate 72, so that defined are ink-channels 78 for receiving ink, nozzles 80 for ejecting ink in the form of droplets, reservoir 82 for the accommodation of supplemental ink, and ink-inlets 84 for connecting ink-channels 78 to the reservoir 82.

Thinned portions of the channel plate 74 underlying the ink-channels 78 are diaphragms 86, each of which bears a common electrode 88 on one surface thereof confronting to the substrate 76. For each diaphragm 86, the substrate 76 is formed with a recess 90 adjacent to the diaphragm 86. Also, a driving electrode 92 is mounted on a bottom of each recess 90 leaving a gap between the common and driving electrodes, 88 and 92, respectively.

In operation, when a voltage is applied between the common and driving electrodes, 88 and 92, an electric attraction force is generated between the electrodes, which biases the thinned diaphragm 86 to bend toward the substrate 76. The displacement of the diaphragm 86 increases a volume of the ink-channel 78, which draws supplemental ink from the reservoir 82 through corresponding ink-inlet 84. Then, when the voltage application is turned off, the displaced diaphragm 86 returns its original position shown in FIG. 8. This pressurizes the ink in the ink-channel 78, ejecting an ink-droplet 94 through the nozzle 80.

As shown in FIG. 9, the bent diaphragm 86 presents the maximum displacement at its central portion 87*a*. That is, the central portion 87*a* provides the minimum gap between the driving electrode 90 and the diaphragm 86 when the diaphragm is deformed.

Generally, the electrostatic attraction force to be generated between two opposing electrodes is inversely proportional to the second power of the distance between the electrodes. This means that the central portion 87*a* that defines the minimum gap between the electrodes is subject to the maximum electrostatic attraction force, which in turn accelerates the displacement of the central portion 87*a*. Therefore, the central portion 87*a* is subject to the maximum stress whenever the voltage is applied between the electrodes. This deteriorates a durability of the diaphragm 86 as well as the head 70.

In addition, in the electrostatic inkjet head, the electrostatic attraction force generated between the opposing electrodes varies with the voltage applied between the electrodes. Ideally, the size of the ink-droplet or amount of ink to be ejected can be controlled by changing the voltage applied. However, this requires a plurality of voltage drivers, for example, low-voltage, middle-voltage, and high-voltage drivers. Disadvantageously, a cost of the driver increases exponentially with the voltage that the driver can supply.

This means that incorporating plural voltage drivers in the inkjet head results in a drastic increase in cost of the inkjet head. Alternatively, it appears to be possible to change the amount of ink to be ejected by changing an opposing area of the electrodes. Practically, however, it is not effective for the high-density inkjet head to change the area of the opposing electrodes for the purpose of increasing the amount of ink to be ejected.

SUMMARY OF THE INVENTION

Accordingly, the object of the present invention is to provide an improved inkjet head capable of overcoming at least one of the above mentioned problems. To achieve the object, according to one aspect of the present invention, an inkjet head includes a first and second electrode. The first electrode is supported by a substrate and the second electrode is supported by a diaphragm so that the second electrode is spaced apart from the first electrode. A drive circuit is connected with the first and second electrodes for applying a voltage between the first and second electrodes so that an electrostatic attraction force is generated between the first and second electrodes. The electrostatic attraction force results in a displacement of the diaphragm toward the substrate and the displacement is utilized for an ejection of ink. Further, the first and second electrodes are positioned so that, when the voltage is turned off, opposing central portions of the first and second electrodes define a gap that is greater than that defined by opposing end portions of the first and second electrodes. Due to this, when the voltage is turned on, the opposing central portions of the first and second electrodes define another gap that is substantially equal to that defined by the opposing end portions of the first and second electrodes.

With this arrangement, when the voltage is applied between the opposing first and second electrodes so that the diaphragm deforms or bends toward the substrate, a nearly constant gap is defined between the first and second electrode. This results in that a nearly uniform stress is generated in the entire diaphragm rather than being provided with any stress concentration which would deteriorate the diaphragm. Therefore, the durability of the diaphragm as well as the inkjet head is extended so much.

Also, the uniformity of the electrostatic force increases a displacement of peripheral portion of the diaphragm, which in turn increase an amount of ink to be ejected.

Further, according to another aspect of the present invention, an inkjet head includes first and second electrode. The first electrode is supported by a substrate and the second electrode is supported by a diaphragm so that the second electrode is spaced apart from the first electrode. A drive circuit is connected with the first and second electrodes for applying a voltage between the first and second electrodes so that an electrostatic attraction force is generated between the first and second electrodes. The electrostatic attraction force results in a displacement of the diaphragm toward the substrate and the displacement is utilized for an ejection of ink. Also, the first electrode and/or second electrode is divided into plural parts so that each of the plural parts of the first electrode and/or second electrode are each electrically disconnected from another part and the plural parts take different distances from the other electrode. Each of the divided parts may be overlapped entirely or partially with another part. The neighboring overlapped parts may be electrically disconnected by an insulative material disposed between them.

With this arrangement, simply by selecting one or more divided parts and then applying the parts with a voltage, the electrostatic attraction force can be changed. This in turn varies an amount of ink to be ejected. Therefore, the amount of ink to be ejected can be changed by the use of cheap and lower-voltage driver even in the high-density inkjet head having a great number of nozzles for ejecting ink.

DETAILED DESCRIPTION OF THE PREFERRED EMBODIMENTS

First Embodiment

Figure 1:
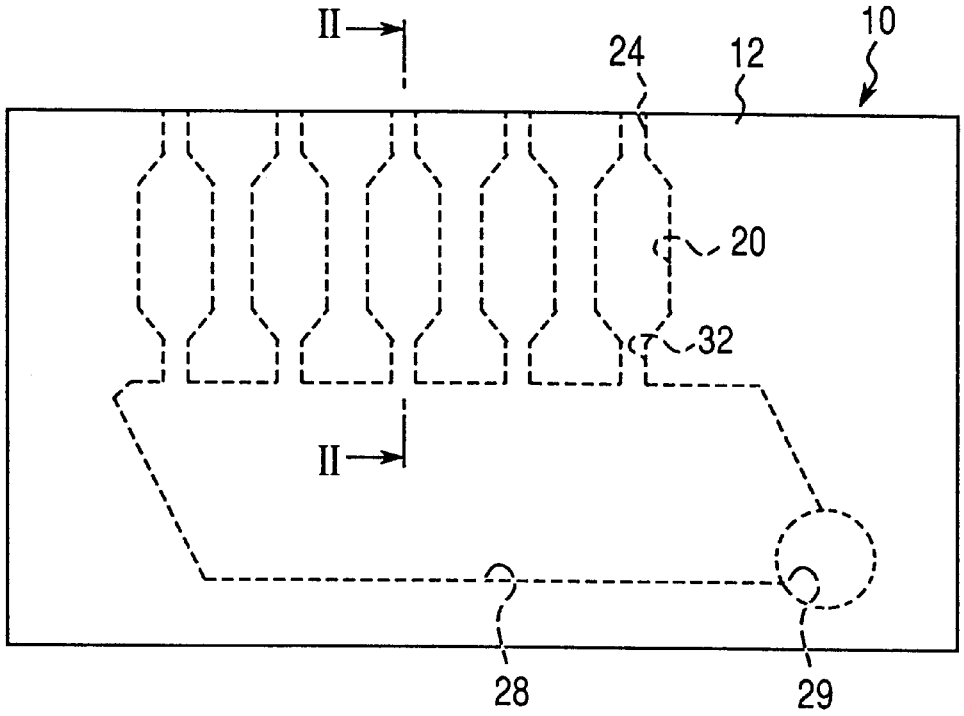
FIG. 1 is an enlarged top plan view of an inkjet head of the first embodiment according to the present invention.
Figure 2:
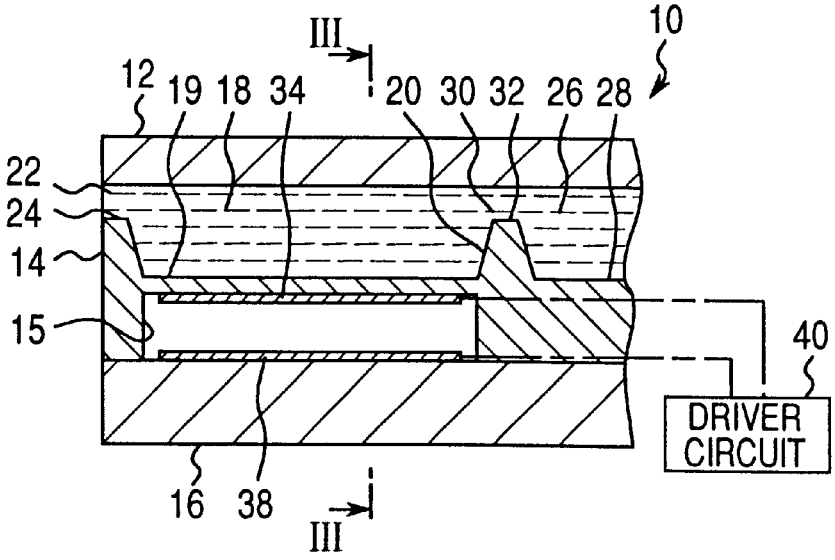
FIG. 2 is a partial cross sectional view of the inkjet head taken along lines II—II in FIG. 1.
Figure 3:
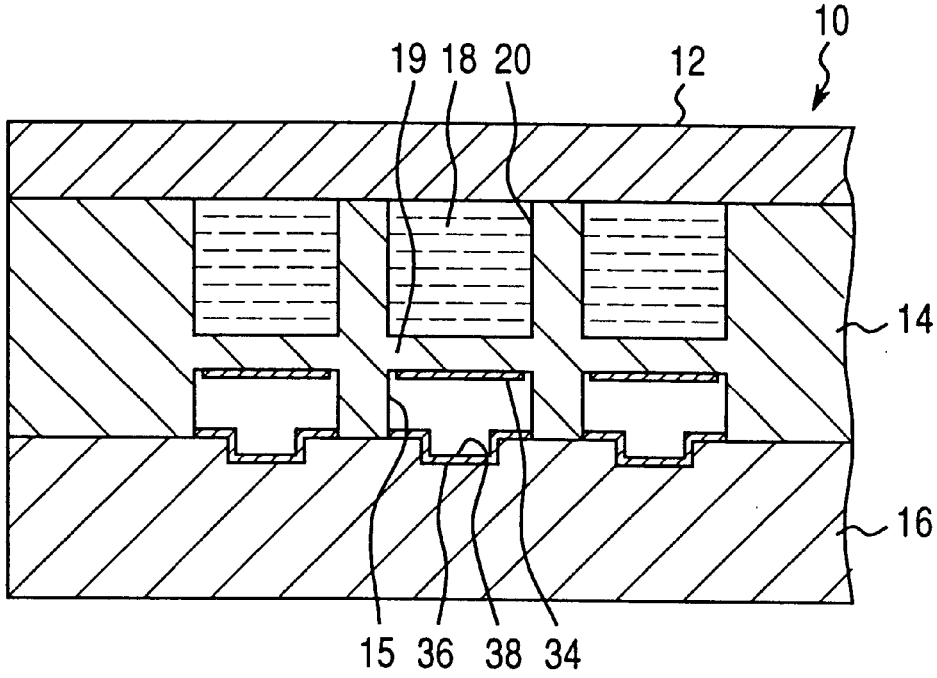
FIG. 3 is a partial cross sectional view of the inkjet head taken along lines III—III in FIG. 2.

With reference to the drawings, in particular to FIGS. 1 to 3, there is illustrated an inkjet head generally indicated by reference numeral 10. Generally, the inkjet head 10 includes three parts; a cover plate 12, channel plate 14, and substrate 16. These parts are assembled and fixed to each other by a suitable bonding technique such as anode bonding and diffused junction methods.

The cover plate 12, preferably made of glass, overlies the channel plate 14. The channel plate 14, made of silicon for example, is formed with a plurality of grooves in an upper surface adjacent to the cover plate 12. Specifically, formed in the upper surface are grooves spaced elongated grooves 20 positioned in a parallel fashion. One side of the channel plate 14 adjacent to the longitudinal ends of the elongated grooves 20 has small grooves 24 each connecting one end of elongated grooves 20 to the atmosphere. The opposite side of the channel plate 14, away from the small grooves 24, includes a lateral groove 28 and a plurality of small grooves 32 each connecting the other ends of the elongated grooves 20 to the lateral groove 28. These grooves 20, 24, 28, and 32 define ink-channels 18, nozzles 22, ink-reservoir 26, and ink-inlets 30, respectively, when the cover plate 12 is mounted on the channel plate 14, which is shown in FIG. 2. The ink-reservoir 26 is further connected to an ink tank (not shown) through a passage 29 so that ink is supplied from the tank through passage 29, ink-reservoir 26 and ink-inlets 30 to the ink-channels 18 and finally to the nozzles 22.

The channel plate 14 is formed in a lower surface thereof adjacent to the substrate 16 with a plurality of elongated recesses 15 each extending adjacent to and along the ink-channels 18, so that each elongated recess 15 cooperates with the opposing ink-channel 18 to define a thinned diaphragm 19 between them. The diaphragm 19 bears a common electrode 34 on one surface defining the elongated recess 15. The common electrode 34 may be formed by a suitable thin film deposition technique such as sputtering.

Figure 4:
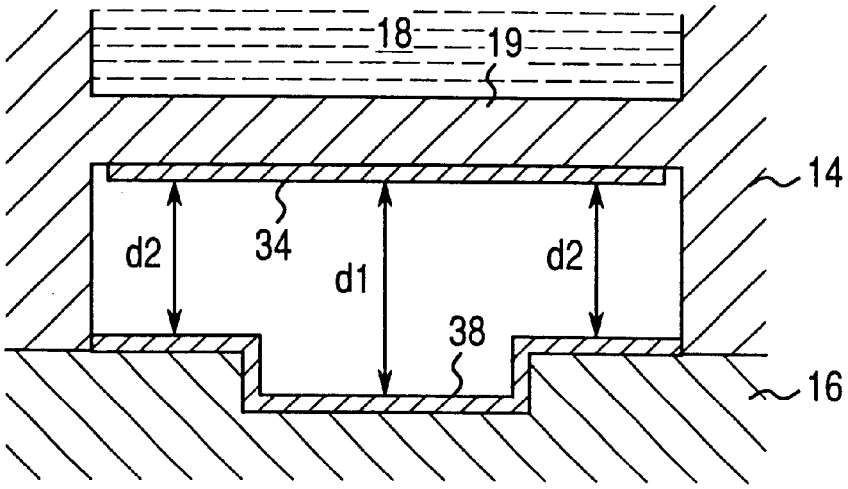
FIG. 4 is an enlarged partial cross sectional view of the inkjet head when a voltage is not applied between the electrodes.

Referring to FIGS. 3 and 4, the surface of the substrate 16, confronting to the channel plate 14, is formed with a plurality of elongated recesses 36 in a parallel fashion at the same intervals as the ink-channels 18. The recesses 36 may be formed by a suitable technique such as etching. The elongated recess 36 is in the form of rectangular cross section having a width that is smaller than that of the recess 15. Therefore, as shown in the drawings, when the channel plate 14 is positioned on the substrate 16, the recess 36 of the substrate 16 can face to a central portion of the recess 15 of the channel plate 14.

In addition, a thinned driving electrode 38 is provided on surface portions of the substrate 16, each of which confronts to the recess 15 of the channel plate 14 when the channel plate 14 is positioned on the substrate 16 with the recess 36 opposed to the center of the recess 15, i.e., an inner surface of each recess 36 and adjacent portions of the substrate 16 located on both sides of each recess 36. The driving electrode 38 is formed by a suitable thin film deposition method such as sputtering. The driving electrodes 38 as well as common electrodes 34 are electrically connected to a driving circuit 40.

As best shown in FIG. 4, due to the existence of the recess 36, the central portion of the driving electrode 38 located on the bottom surface of the recess 36 defines a gap d1 between the opposing central portions of the electrodes 34 and 38. On the other hand, the side portions of the driving electrode 38 adjacent to the recess 36 define a gap d2 that is smaller than the gap dl between the opposing side portions of the electrodes 34 and 38.

In operation of the inkjet head 10 so constructed, ink is supplied from the tank through the passage 29 and ink-inlets 30 to the ink-channels 18. In this state, when a voltage or pulse is applied from the driving circuit 40 between the common and driving electrodes, 34 and 38, an electrostatic attraction force is generated between the electrodes, which allows the thinned diaphragm 19 to bend toward the substrate 16. This increases the volume of the ink-channel 18 to introduce a negative pressure in the ink-channel 18, so that supplemental ink is drawn into the ink-channel 18 through the corresponding ink-inlet 30. Then, when the voltage application is turned off, the bent diaphragm 19 returns instantly to its original position shown in FIG. 2 by its elasticity. At this moment, the volume of the ink-channel decreases to its original state. This pressurizes the ink in the ink-channel, ejecting an ink droplet out of the nozzle 22. The droplet is then deposited on a recording medium such as paper to form a dot. Also, with a number of dots so defined, an image is produced on the recording medium.

Figure 5:
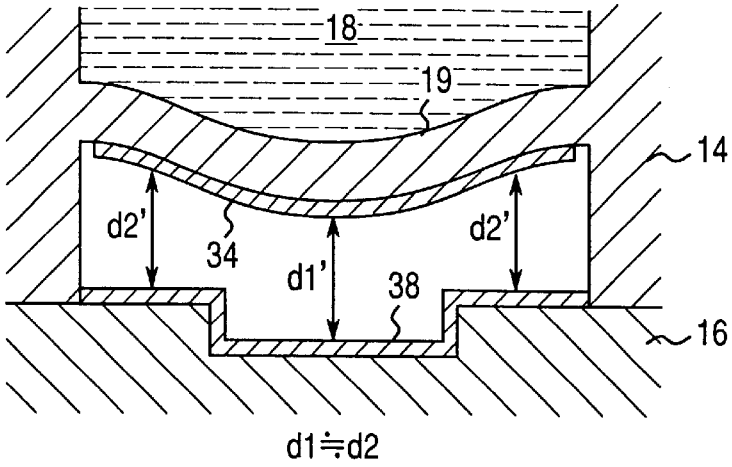
FIG. 5 is an enlarged partial cross sectional view of the inkjet head when the voltage is applied between the electrodes, showing a deformation of a diaphragm.

Because of the existence of the first and second recesses, 15 and 36, when the diaphragm 19 is bent as shown in FIG. 5 the gap d1' between the central portions of the common and driving electrodes, 34 and 38, becomes substantially equal to the gap d2' between the side portions thereof. Typically, the electrostatic attraction force exerted between the common and driving electrodes can be expressed by the following equation:

$$P = \frac{1}{2}\varepsilon_r\varepsilon_0 S\left(\frac{V}{d}\right)^2$$

wherein

P: restoring force, $\epsilon_r$: relative permittivity in gap between electrodes, $\epsilon_0$: relative permittivity in vacuum ($8.854\times10^{-12}$ F/m), S: opposing areas of electrodes;

V: voltage, and d: distance between electrodes.

Figure 8:
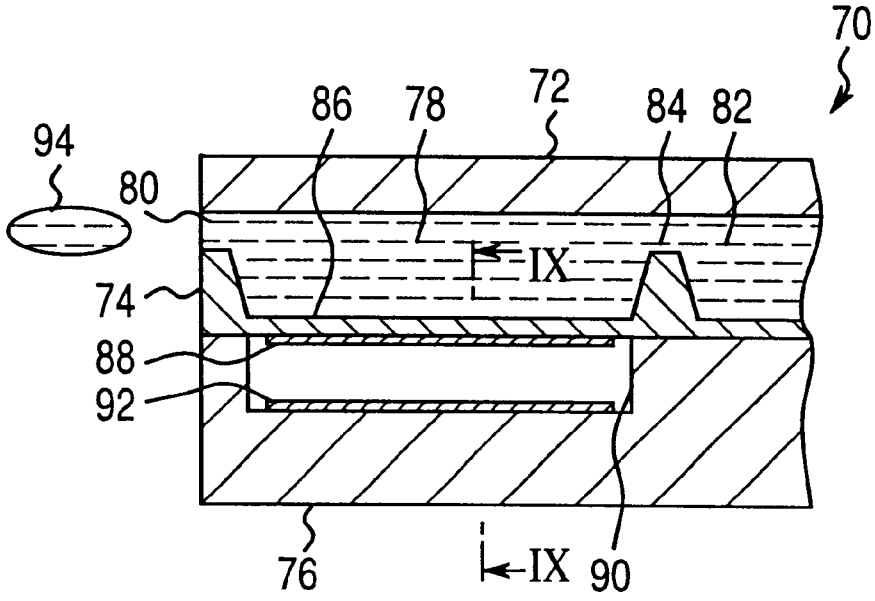
Fig.8 PRIOR ART
FIG. 8 is an enlarged partial cross sectional view of a conventional inkjet head.
Figure 9:
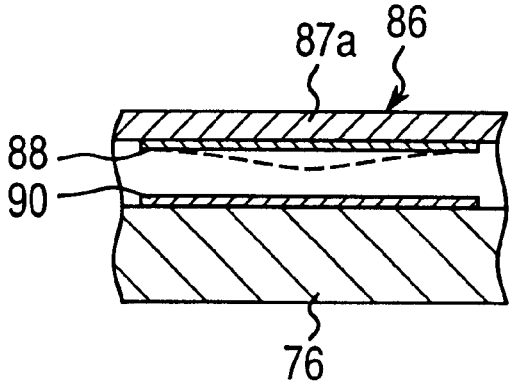
Fig.9 PRIOR ART
FIG. 9 is an enlarged partial cross sectional view of the conventional inkjet head, showing the deformation of the diaphragm.

As can be seen from the above-equation, substantially the same magnitude of electrostatic attraction force is generated in the gaps d1' and d2', i.e., in the central and side portions of between the electrodes. This allows that the substantially same magnitude of stress is exerted in the entire area of the diaphragm 19 free from any stress concentration that is caused in the conventional inkjet head shown in FIG. 8. This results in that the durability of the inkjet head as well as the diaphragm 19 will be increased so much.- Also, the electrostatic attraction force distributes uniformly between the electrodes, which increases the displacement of the side portions of the diaphragm 19 and the resultant force for ink ejection.

Figure 6:
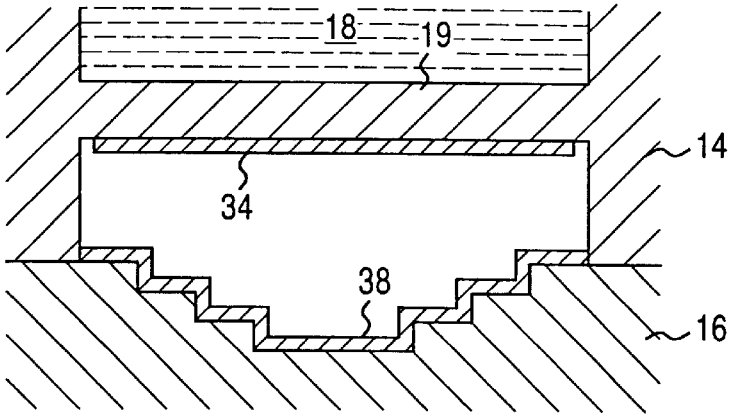
FIG. 6 is an enlarged partial cross sectional view of the inkjet head in which the substrate is recessed stepwise.
Figure 7:
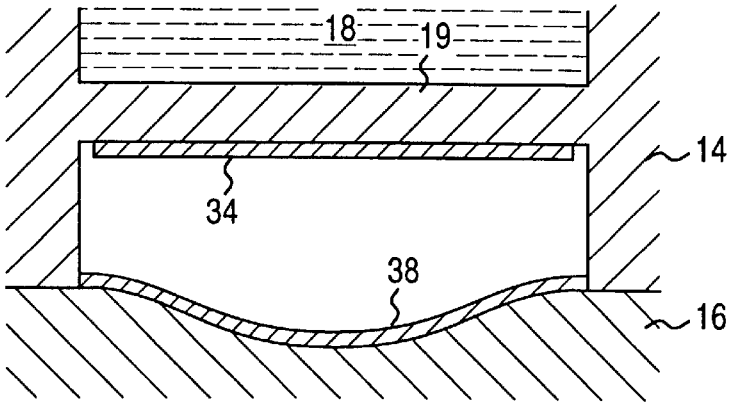
FIG. 7 is an enlarged partial cross sectional view of the inkjet head in which the substrate is recessed to define a curved surface.

Although in the previous embodiment only one recess 36 is formed in the substrate 16 for each diaphragm 19, as shown in FIG. 6 the substrate 16 may be recessed stepwise to form a nearly constant gap between the common and driving electrodes when the diaphragm is deformed. The stepped recesses may be formed by, for example, etching.

Alternatively, the substrate 16 may be recessed so that the bottom surface of the recess 36 draws a curve that corresponds to the bent diaphragm 19 and thereby leaves a constant gap at every place between the bent diaphragm or common electrode and the opposing driving electrode.

Also, although in the previous embodiment the substrate supporting the driving electrode is recessed, another substrate or diaphragm bearing the common electrode may be recessed stepwise or curved to form a constant gap at every place between the opposing electrodes at the deformation of the diaphragm.

Further, although in the previous embodiment the common electrode 34 is mounted on the diaphragm and the driving electrode 38 is on the substrate, they may be replaced by the other.

Furthermore, although the electrodes are made on by sputtering, they may be formed in the surfaces of the substrate and diaphragm by doping ion of boron and thereby providing conductivity thereto.

Second Embodiment

Figure 10:
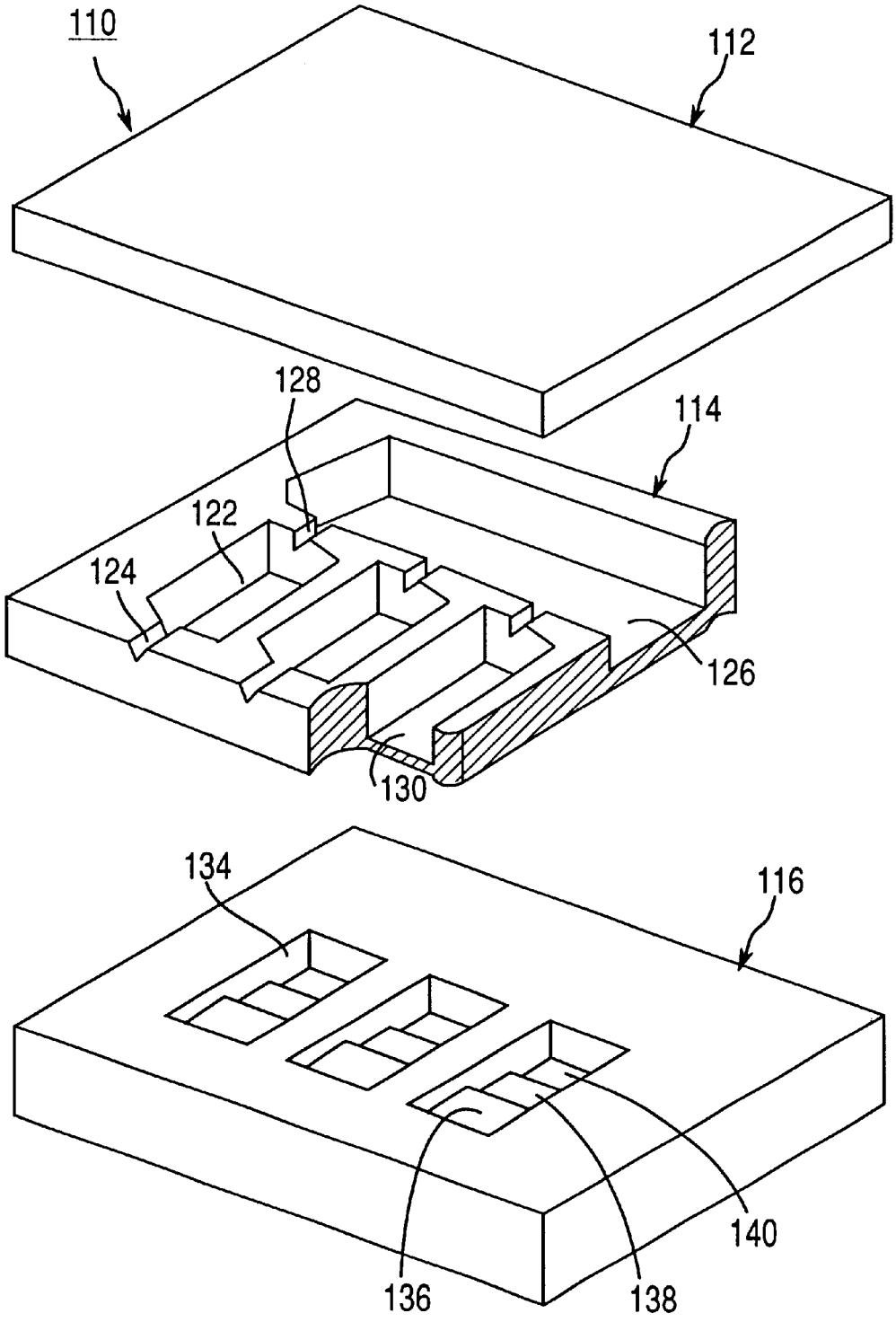
FIG. 10 is an enlarged exploded perspective view of an inkjet head of the second embodiment according to the present invention.
Figure 11:
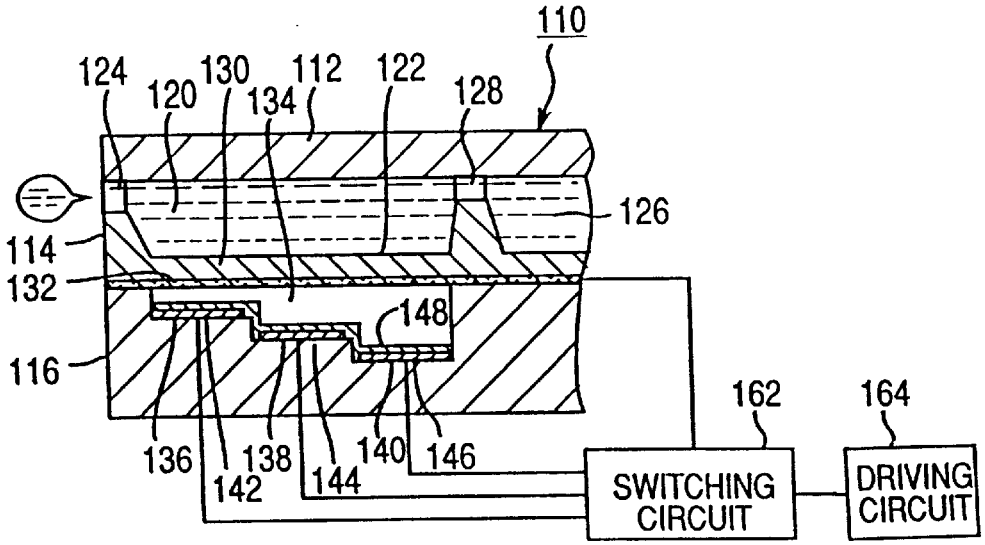
FIG. 11 is an enlarged partial cross sectional view of the inkjet head in FIG. 10.
Figure 12:
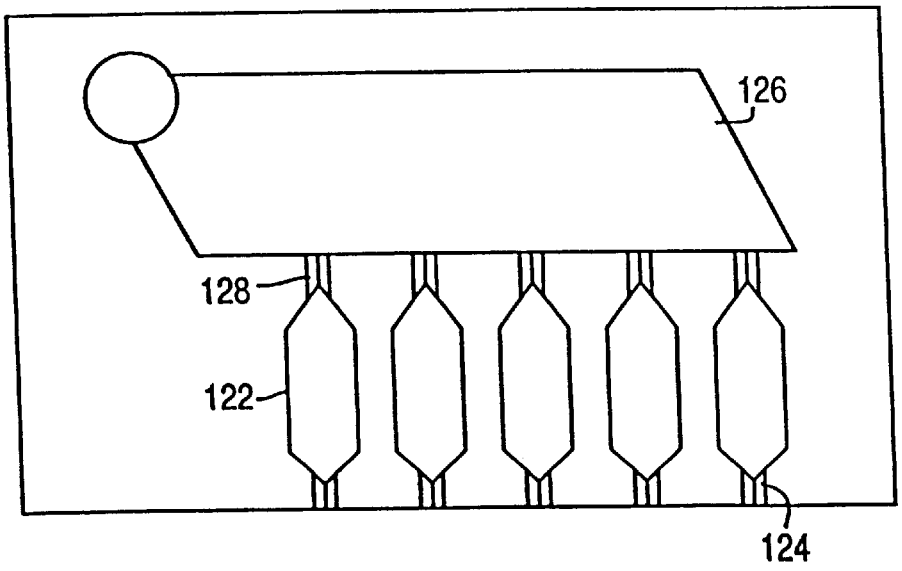
FIG. 12 is a top plan view of a second substrate of the inkjet head in FIG. 10.

FIGS. 10 and 11 show an inkjet head of the second embodiment according to the present invention, generally indicated by reference numeral 110. Similar to the inkjet head 10 of the first embodiment, the inkjet head 110 includes first to third substrates 112, 114, and 116, arranged one on top the other. These substrates may be made of any material such as metallic, non-metallic, glass, and resin materials. Suitable materials are, for example, silicon, photosensitive glass, nickel, and ink resistant resins such as polyimide and polysulfone. In this embodiment, the substrates 112 and 116 are made of borosilicate glass and the substrate 114 is made of silicon. The substrates may be bonded to each other by a suitable bonding technique, such as, anode bonding and diffused junction methods.

The second substrate 114 is formed in one surface confronting to the first substrate 112 with a number of grooves capable of receiving ink, i.e., ink-channels 122, nozzles 124 each connecting ink-channels 122 to the atmosphere for ink-ejection, ink-reservoir 126 for the accommodation of supplemental ink, and ink-inlets 128 each connecting ink-channels 122 to the ink-reservoir 126, by a suitable method such as etching. This also forms diaphragms 130, each of which defines a thinned bottom wall of the ink-channel 122. Preferably, the diaphragm 130 has a thickness of about three micrometers. Also, a surface of the second substrate 114 adjacent to the third substrate 116 is doped with boron ion to form a conductive layer or common electrode 132. It should be noted that the boron-doped layer, if it is made before the etching, can serve as an etching stop layer.

The third substrate 116 is formed in its surface adjacent to the second substrate 114 with a number of recesses 134 each confronting to the diaphragms 130. In particular, the recess 134 is stepped to form three stages 136, 138, and 140 so that the stage 136 adjacent to the nozzle 124 has the minimum depth and the stage 140 away from the nozzle has the maximum depth. The stages 136, 138, and 140 are provided with driving electrodes or separated electrodes 142, 144, and 146, respectively, using a well known film deposition technique so that the driving electrodes 142, 144, and 146 define different distances between the diaphragm 130 and the electrodes. Preferably, the distances may be 0.4, 0.45, and 0.5 $\mu$m.

Figures 13A, 13B, 13C, 13D, 13E, 13F, 13G, 13H, 13I, 13J:
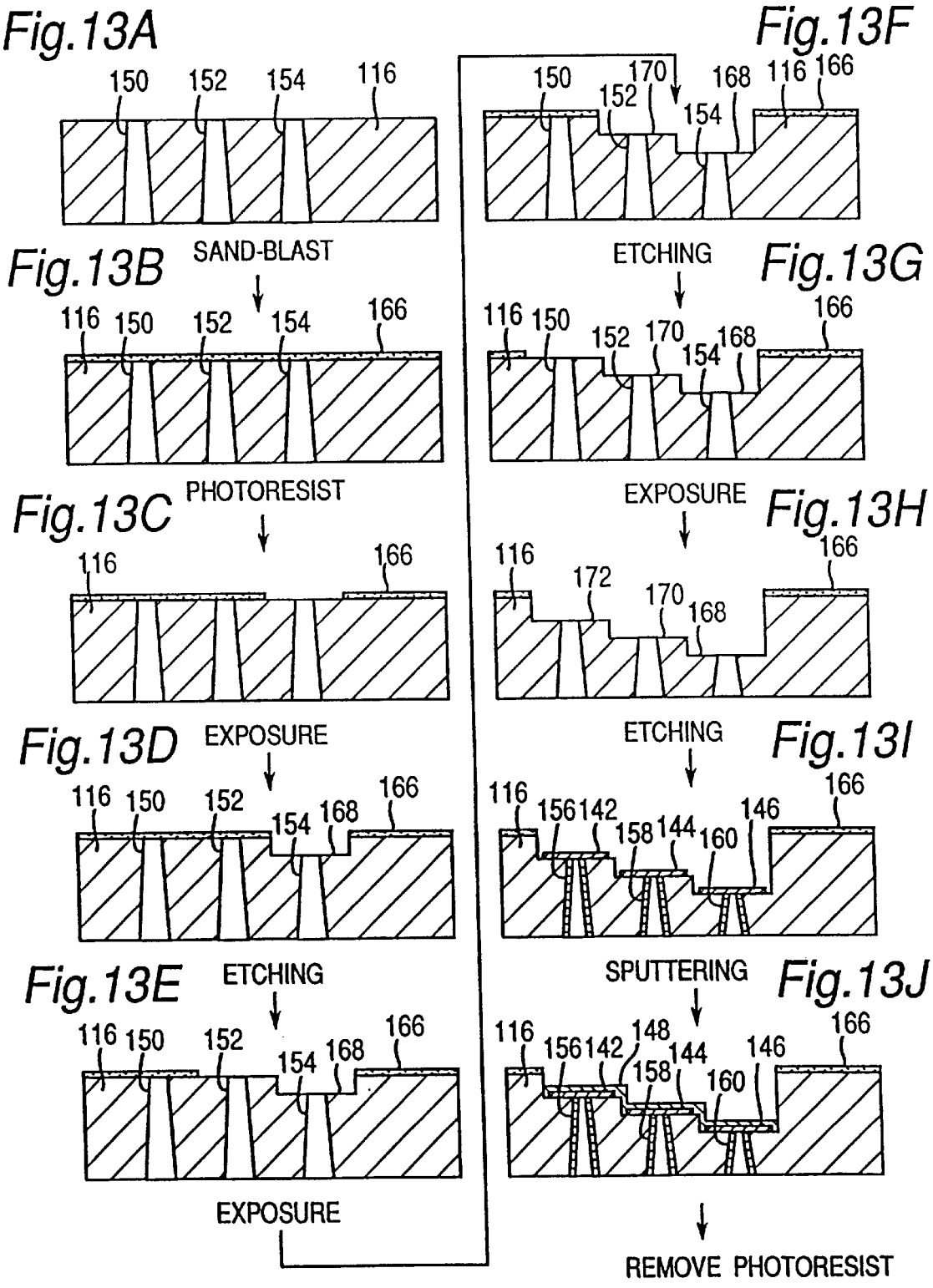
FIGS. 13A to 13J show a process for forming stages in steps in the substrate.

The driving electrodes 142, 144, and 146 are covered by an insulative layer 148 of insulative material such as silicon nitride. The insulative layer 148 may have a thickness of about 0.1 $\mu$m. The driving electrodes 142, 144, and 146 are electrically connected through respective conductive leads 156, 158, and 160 (see FIG. 13) to a switching circuit 162, allowing the driving electrodes to be applied with a constant voltage individually. The switching circuit 162 is also connected to the common electrode 132. Further, the switching circuit 162 is connected to a driving circuit 164 so that an image signal is transmitted from the driving circuit 164 to the switching circuit 162.

In operation of the inkjet head 110 so constructed, the image signal is transmitted from the driving circuit 164 to the switching circuit 162. The image signal includes a first signal commanding that ink 120 should be ejected and a second signal commanding which driving electrodes 142, 144, or 146 should be biased. The switching circuit 162 recognizes the driving electrode 142, 144, and 146 to be biased from the second signal and then applies a predetermined voltage between the common electrode 132 and the selected driving electrode 142, 144, or 146. This results in an electrostatic attraction force generated between the common electrode 132 and the selected driving electrode 142, 144, or 146. The electrostatic attraction force bends the thinned diaphragm 130 supporting the common electrode 132 toward the biased driving electrode 142, 144, or 146. At this moment, the insulative layer 148 prevents the deformed diaphragm 130 from making a possible contact with the driving electrodes 142, 144, and 146. In addition, when the insulative layer 148 is made of silicon nitride which has a relative permittivity of about twenty times higher than air, it will provide another advantage of increasing the electrostatic attraction force between the biased electrodes.

Due to the deformation of the diaphragm 130, a negative pressure is introduced in the ink channel 122, which draws ink 120 from the ink reservoir 126 through the ink-inlet 128 into the ink-channel 122. When the image signal is turned off, the electrostatic attraction force is eliminated from between the common electrode 132 and the selected driving electrode 142, 144, or 146. This allows the diaphragm 130 to return its original position (see FIG. 11), which causes ink 120 in the corresponding ink-channel 122 to be pressurized to eject through the corresponding nozzle 124.

As can be seen from the above-described equation, the electrostatic attraction force generated between the opposing electrodes varies inversely with the second power of the distance between the electrodes. Then, assume that a constant voltage is applied between the common electrode and three driving electrodes 142, 144, and 146, independently. In this instance, biasing the driving electrode 146 minimizes the electrostatic attraction force, the displacement of the diaphragm 130, and an amount of ink to be ejected. On the other hand, biasing the driving electrode 142 maximizes electrostatic attraction force, the displacement of the diaphragm 130, and the amount of ink to be ejected. This means that the inkjet head 110 can eject ink droplets having different sizes (i.e., minimum, medium, and. maximum sizes) simply by selecting the electrode to be biased. Specifically, when the driving electrode 142, 144, or 146 is biased, the maximum-, medium, or minimum-size ink-droplet will be ejected, respectively. In addition, a tone of the resultant image may be changed in various manners simply by selecting electrode to be biased. Further, the amount of ink to be ejected can be controlled in more steps by biasing two or more selected electrodes.

Ink ejection tests were made to the inkjet head of this embodiment. As a result, when a voltage of 40 volts was applied to electrodes 142, 144, and 146, respectively, ink of 60, 38, and 20 picoliters were ejected. When the same voltage of 40 volts was applied to both electrodes 142 and 144 simultaneously, ink of 105 picoliters was ejected. Likewise, the same voltage of 40 volts was applied to both electrodes 144 and 146, ink of 65 picoliters was ejected. When the same voltage of 40 volts was applied to three electrodes 142, 144, and 146 at the same time, ink of 135 picoliters was ejected.

FIGS. 13A–13J show one process for forming driving electrodes 142, 144, and 146 and leads therefor on the substrate 116. In this process, the substrate is formed with a number of through-holes 150, 152, and 154 for three electrodes by a well-known technique such as sandblasting. Then, a photoresist 166 is applied on one surface of the substrate 116. Subsequently, the photoresist 166 is exposed by the use of a mask pattern not shown, so that a part of the photoresist corresponding to the electrode 146 can be removed. The substrate is further etched to form a recess 168. Then, the photoresist 166 is further exposed to remove another part thereof corresponding to the electrode 144 and then etched to form another recess 170. At this etching, the first recess 168 is further recessed so that the recess 168 has a greater depth than the second recess 170. Likewise, another exposure and etching are made to the substrate to form three recesses or steps 168, 170, and 172 having different depths. Then, the electrodes 142, 144, 146 are formed on steps 168, 172, and 170, respectively, by the use of a well-known thin film deposition technique such as sputtering and chemical vapor deposition (CVD). Simultaneously or after the formation of the electrodes, the through-holes 150, 152, and 154 are provided with respective leads 156, 158, and 160 by the use of known thin film deposition technique such as sputtering and CVD. Finally, the insulative layer 148 is formed on the driving electrodes 142, 144, and 146 and then the photoresist 166 is removed from the substrate 116.

Figure 14:
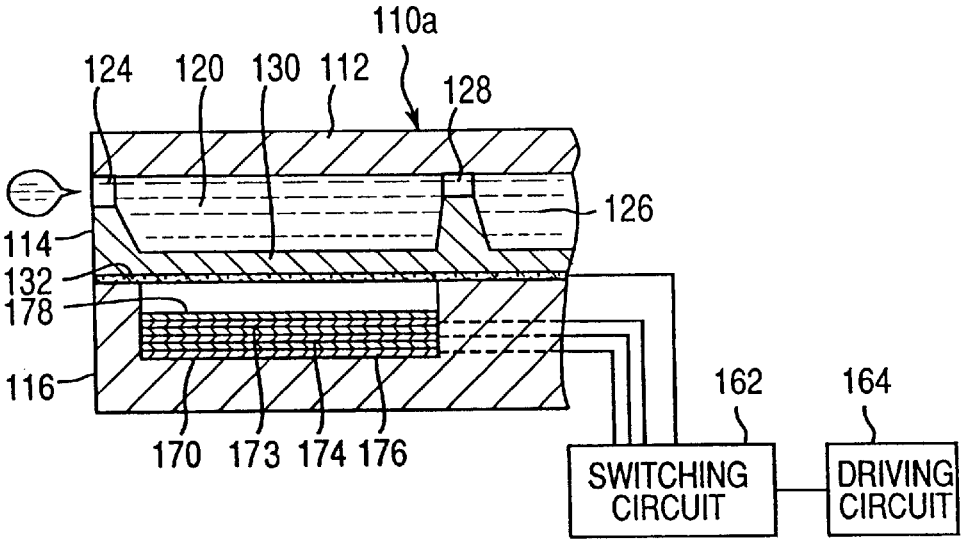
FIG. 14 is a partial cross sectional view of a modified inkjet head of the present invention, in which an electrode is a multi-layered electrode.

FIG. 14 shows another inkjet head 110*a*, in which recesses 170 are formed in the surface of the third substrate 116 adjacent to the second substrate 114 so that each of the recesses 170 can face to the corresponding diaphragm 130. In each recess 170, three driving electrodes 173, 174, and 176 are layered one on top the other so that the top electrode 173 takes the minimum distance and the bottom electrode 176 takes maximum distance from the diaphragm 130. Insulative layers 178 are provided between the neighboring electrodes 173 and 174, and 174 and 176 so that each electrode is electrically disconnected from the other. The insulative layer 178 is also provided on the top electrode 173 so that the common electrode 132 will make no electrical contact with the electrode at the displacement of the diaphragm 130.

Figure 15:
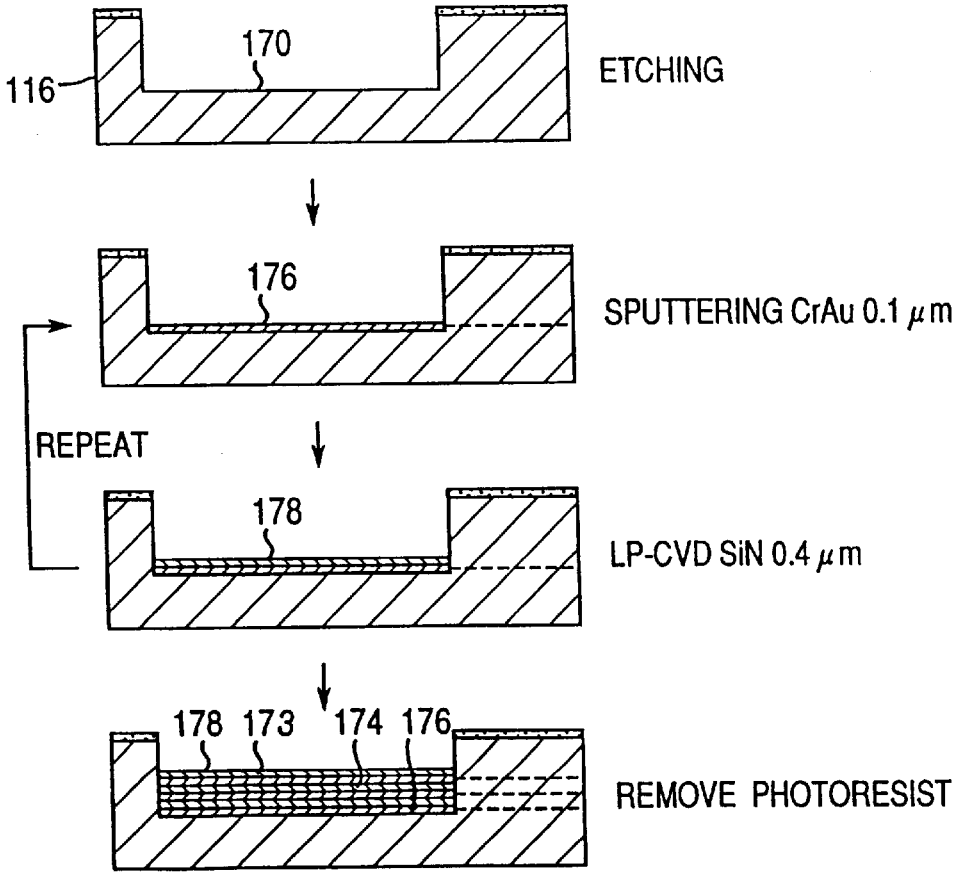
FIG. 15 shows a process for forming a multi-layered electrode.

FIG. 15 shows a process for making recesses and electrodes shown in FIG. 14. In this process, at least one recess 170 is formed in one surface of the substrate 116 by, for example, etching. Then, a driving electrode 176 having a thickness of about 0.1 $\mu$m is provided on the bottom of each recess by sputtering of conductive material such as chromium gold (CrAu). Next, the insulative layer 178 made of silicone nitride is provided on the driving electrode 176 by the use of chemical vapor deposition method. The sputtering and deposition are further repeated, so that driving electrodes 174 and 173 and the insulative layers 178 between the driving electrodes and on the top electrode 173 are formed. Preferably, the insulative layer 178 on the top electrode 173 has a thickness of about 0.1 $\mu$m. The driving electrodes 173, 174, and 176 are electrically connected with a switching circuit 162 through respective leads. Preferably, the leads are made at the same time with the corresponding electrodes. As can be seen from above, it is not necessary to make through-holes in the substrate, which are required for the previous inkjet head.

Several ink ejection tests were made to the modified inkjet head in FIG. 14. In these tests, a voltage of 40 volts was applied to the driving electrodes 173, 174, and 176, independently. As a result, an amount of ink ejected from the nozzle were 65, 40, and 25 picoliters for respective electrodes 173, 174, and 176.

The materials described above for respective members and parts are not limited thereto. For example, the electrodes may be made of other material having lower conductivity such as ITO, $SnO_2$, and Pt as well as CrAu. Also, the insulative layer may be made of other material such as SiC, $SiO_2$, and MgO as well as SiN.

Figure 16:
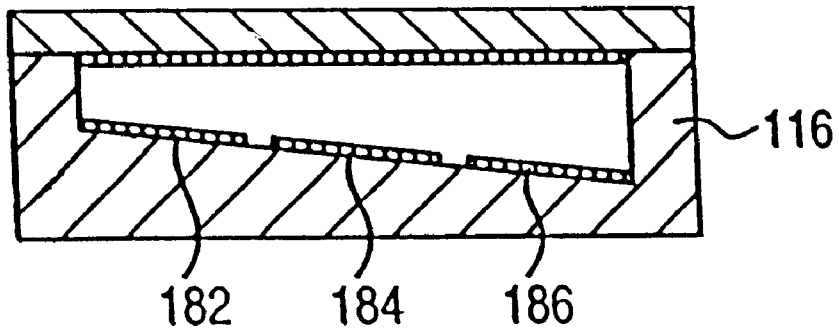
FIG. 16 is a partial cross sectional view of another modified inkjet head, showing divided parts of the electrode provided on a declined bottom surface of the recess.
Figure 17:
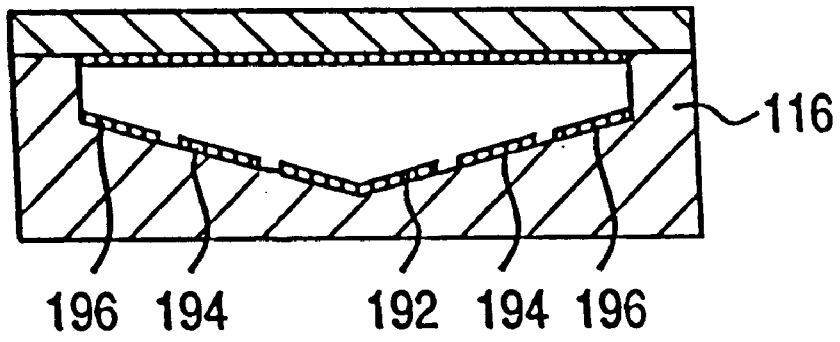
FIG. 17 is a partial cross sectional view of another modified inkjet head, showing divided parts of the electrode provided on a V-shaped bottom surface of the recess.

Further, the arrangement of the electrodes is not limited to the above-described embodiments, they may be arranged in different manners. For example, FIG. 16 shows another arrangement of the electrodes. In this arrangement, the recess is formed in the substrate by etching so that its bottom declines in the longitudinal direction of the ink-channel. The driving electrodes 182, 184, and 186 are positioned on the bottom along the longitudinal direction so that each electrode is spaced away from the other. FIG. 17 shows another arrangement of the electrodes. In this arrangement, the bottom of the recess draws a V-shaped outline in the longitudinal direction of the ink-channel. The V-shaped bottom configuration may be formed by etching. Also, the electrodes 192, 194, and 196 are deposited on the bottom of the recess so that the electrode 192 positions at the bottom-most of the recess, and the electrodes 196 at opposite sides of the bottom surface of the recess, and remaining electrodes 194 each between the electrodes 192 and 196.

Although in the previous embodiments, three electrodes are provided in the recess, the number of the electrodes is not restrictive and it may be two or more.

Also, although the common electrode is made by ion-doping, it may be made by a suitable thin film deposition method such as sputtering.

Further, although the electrodes are independent of the supporting substrate, the substrate can be used for electrodes if it is made of conductive material.

Furthermore, although in the previous embodiments the driving electrode is divided into three parts for each ink-channel, the common electrode may be divided into parts instead. In this instance, the divided parts are electrically connected through respective leads with the switching circuit so that each divided part can be biased individually.

Moreover, although in the multi-layered embodiment each electrode is entirely overlapped on the other, it may be overlapped in part on the other electrodes. In this instance, by changing the overlapping length or area of the multi-layered electrodes, the amount of ink to be ejected can be controlled simply by selecting electrode to be biased.

The present application is based upon Japanese Patent Applications Nos. 10-094426 and 10-101160, the contents of which are incorporated herein by reference.

What is claimed is:

1. An electrostatic inkjet head, comprising:

a first electrode;

a substrate supporting said first electrode;

a second electrode spaced apart from said first electrode;

a diaphragm supporting said second electrode; and a drive circuit connected with said first and second electrode for applying a voltage between said first and second electrodes so that an electrostatic attraction force is generated between said first and second electrodes, wherein said electrostatic attraction force results in a displacement of said diaphragm toward said substrate and said displacement is utilized for an ejection of ink;

wherein said first and second electrodes are positioned so that, when said voltage is turned off, opposing central portions of said first and second electrodes define a gap that is greater than that defined by opposing end portions of said first and second electrodes and, when said voltage is turned on, said opposing central portions of said first and second electrodes define another gap that is substantially equal to that defined by said opposing end portions of said first and second electrodes.

2. An electrostatic inkjet head in accordance with claim 1, wherein said central portion of said first or second electrode is recessed.

3. An electrostatic inkjet head in accordance with claim 1, wherein said central portion of said first or second electrode is recessed stepwise.

4. An electrostatic inkjet head in accordance with claim 1, wherein said central portion of said first or second electrode is recessed to draw a curve.

5. An electrostatic inkjet head, comprising:

a first electrode a substrate supporting said first electrode;

a second electrode spaced apart from said first electrode;

a diaphragm supporting said second electrode; and a drive circuit connected with said first and second electrode for applying a voltage between said first and second electrodes so that an electrostatic attraction force is generated between said first and second electrodes, wherein said electrostatic attraction force results in a displacement of said diaphragm toward said substrate and said displacement is utilized for an ejection of ink;

wherein at least one of said first electrode and said second electrode is divided into plural parts so that each of said plural parts is electrically disconnected from the others of said plural parts and the plural parts of one of said electrodes are at different distances from the other electrode.

6. An electrostatic inkjet head in accordance with claim 5, wherein each of said divided parts is not overlapped with another part.

7. An electrostatic inkjet head in accordance with claim 5, wherein each of said divided parts is entirely or partially overlapped with another part.

8. An electrostatic inkjet head in accordance with claim 7, wherein neighboring overlapped parts are electrically disconnected by an insulative material disposed between said neighboring overlapped parts.

* * * * *

UNITED STATES PATENT AND TRADEMARK OFFICE

CERTIFICATE OF CORRECTION

PATENT NO. : 6,322,198 B1
DATED : November 27, 2001
INVENTOR(S) : Kusunoki Higashino et al.

It is certified that error appears in the above-identified patent and that said Letters Patent is hereby corrected as shown below:

Column 4,
Line 1, delete the first instance of “grooves”, and insert -- equally --.

Column 8,
Line 28, delete “at least one recess”, and insert -- the recesses --.
Line 29, delete “is”, and insert -- are --.
Line 30, delete “a driving electrode”, and insert -- the driving electrodes --.
Line 31, delete “is”, and insert -- are --.
Line 31, delete “each”, and insert -- the --.
Line 32, delete “recess”, and insert -- recesses --.
Line 36, after “that”, insert -- another --.
Line 44, after “above”, delete “, it”, and insert -- that --.

Signed and Sealed this

Thirtieth Day of September, 2003

JAMES E. ROGAN
*Director of the United States Patent and Trademark Office*